US007142093B2

(12) United States Patent
Foster et al.

(10) Patent No.: US 7,142,093 B2
(45) Date of Patent: Nov. 28, 2006

(54) FIRE ALARM MODULE

(75) Inventors: Andrew Foster, Parbold (GB); Anthony Roberts, Preston (GB)

(73) Assignee: Computionics Limited (GB)

( * ) Notice: Subject to any disclaimer, the term of this patent is extended or adjusted under 35 U.S.C. 154(b) by 0 days.

(21) Appl. No.: 10/485,066

(22) PCT Filed: Jul. 26, 2002

(86) PCT No.: PCT/GB02/03447

§ 371 (c)(1),
(2), (4) Date: Jan. 27, 2004

(87) PCT Pub. No.: WO03/012759

PCT Pub. Date: Feb. 13, 2003

(65) Prior Publication Data

US 2004/0196145 A1 Oct. 7, 2004

(30) Foreign Application Priority Data

Jul. 28, 2001 (GB) ..... 0118442.3

(51) Int. Cl.
*G08B 17/00* (2006.01)

(52) U.S. Cl. ..... 340/286.05; 340/506; 116/5

(58) Field of Classification Search ..... 340/286.05, 340/326, 332, 506
See application file for complete search history.

(56) References Cited

U.S. PATENT DOCUMENTS

| | | | | |
|---|---|---|---|---|
| 4,881,058 | A * | 11/1989 | Berry, III | 340/326 |
| 5,608,375 | A * | 3/1997 | Kosich | 340/293 |
| 5,724,020 | A * | 3/1998 | Hsu | 340/286.05 |
| 6,060,994 | A * | 5/2000 | Chen | 340/521 |
| 6,400,265 | B1 * | 6/2002 | Saylor et al. | 340/531 |
| 6,778,081 | B1 * | 8/2004 | Matheny | 340/506 |

* cited by examiner

*Primary Examiner*—Daniel Wu
*Assistant Examiner*—George Bugg
(74) *Attorney, Agent, or Firm*—Salter & Michaelson

(57) ABSTRACT

A fire alarm system comprises one or more fire alarm addressable modules (3), which interface with a fire alarm loop (1) along which data and power may be transmitted, and a voice alarm system comprising one or more amplifiers (6) connected to respective speakers (7) for transmitting voice alarm messages. The or each fire alarm module comprises a message store (22), means for interfacing with an amplifier (6) of the voice alarm system, means for interfacing with the fire alarm loop (1) and means for interpreting signals from the loop (1) and for selecting an appropriate message for transmission from the message store (22).

23 Claims, 3 Drawing Sheets

FIRE ALARM MODULE

TECHNICAL FIELD

The present invention relates to a fire alarm module for a fire alarm system.

BACKGROUND OF THE INVENTION

There is increasing demand for voice alarm systems resulting from an increased awareness on health and safety issues and legislation.

Essentially a voice alarm (VA) system is the sounder part of a fire alarm system. The two are inextricably linked and must work together. In the U.K. there are two standard codes of practice for the installation of fire alarm (FA) and voice alarm (VA) systems, these are BS 5839 pts 1 and 8 respectively.

VA systems tend to be expensive to install and they also tend to be installed by the audio industry, (public address (PA) type audio contractors). There is quite often a conflict at the interface of the two systems where the contractors and equipment meet.

Traditionally PA equipment has been build in 19" racks from discrete parts. There has then been introduced a form of control console and interface with the FA system. Most of these systems are centralised although there are one or two so called distributed systems available. All of these systems basically work in the same manner viz;

- The FA system detects a fire and gives a corresponding signal to the VA system via an interface.
- This interface whilst capable of being intelligent is almost always in the form of discrete relay switches of one form or another because of the incompatibility between the two systems.
- The VA system comprises a control section which then works out what this signal should be interpreted as via its programming and then routes a required pre-recorded digital message to a correct array of amplifiers.
- The amplifiers then route these appropriate messages to correct sets of speakers.
- The VA control system is responsible for interpreting the incoming signal and deciding the priority of the message (compared to other current audio signals) and the routing of the response through its own programming regime.
- The VA control system is responsible for monitoring itself and its external wiring and giving life safety fault messages back to the FA equipment in a manner prescribed by the aforementioned standards.

In the types of buildings that require VA systems to be installed there is also quite often a need for a PA system. Traditionally the two systems form just one (hence the involvement of the PA installation industry) where the standards dictate that the life safety function is paramount amongst other requirements. All equipment is currently made to be capable of being extended into the PA mode for example switching matrixes and paging panels are available to be connected to the equipment so that it may also be used as a PA system.

Current VA systems in their most rudimentary of forms tend to come in small racks requiring connection interfacing and programming into the FA system as a minimum. Currently the lowest available price for the smallest of such systems is well in excess of £2K.

In almost all cases where a VA system is required there will be installed an analogue addressable type of FA system. These systems have many detectors/manual call points/peripheral devices connected to one pair of wires going round a building in the form of a loop both beginning and ending at the control equipment. The devices connected to these 'loops' are termed analogue addressable devices since they each have an individual address and communicate continuously backwards and forwards individually with the control equipment using the pair of wires as both a power source and the data highway. One type of device that fits onto these 'loops' is termed an 'output unit' which is basically an addressable relay. One common way of triggering the VA is by an array of these output units where they are programmed in the FA control panel to give outputs at specific times under specific conditions of various detectors/manual call points being triggered.

It can be seen therefore that the interfacing of the two systems can become quite complex and that both systems require a degree of programming and interfacing. This can become quite involved and contentious when the two systems are to an extent incompatible.

It is known in the marketplace that there is a likelihood of a PA system being required as well as a VA system. However, specifications tend to be directed at providing the statutory function of VA as opposed to the utility function of PA. It is therefore not necessary to accommodate any normal PA function within the equipment, just the facility to be able to extend it to also provide this utility function at some future time and place.

SUMMARY OF THE INVENTION

According to one aspect of the present invention there is provided a fire alarm addressable module comprising means for interfacing with an amplifier forming part of a voice alarm system, means for interfacing with a fire alarm loop along which data and power may be transmitted, a message store for storing one or more alarm messages and means for interpreting signals received from the loop and for selecting an appropriate message for transmission from the message store.

According to another aspect of the present invention, there is provided a fire alarm system comprising a fire alarm loop along which data and power may be transmitted, a voice alarm system comprising one or more amplifiers, the or each amplifier being connected to one or more speakers for transmitting voice alarm messages, and one or more fire alarm addressable modules, the or each module comprising a message store, means for interfacing with an amplifier of the voice alarm system, means for interfacing with the afire alarm loop and means for interpreting signals from the loop and for selecting an appropriate message for transmission from the message store.

In a preferred embodiment of the invention, the loop comprises control equipment for controlling the transmission of power and data over the loop. Provision is made for a connection of amplifiers. A fireman's control panel is provided through which instructions can be fed to the system. Where a plurality of modules are provided and PA/VA functionality is required then a PA/VA switching/monitoring/routing matrix unit may be provided with a sophisticated fireman's control panel or other routing device as required.

DESCRIPTION OF THE DRAWINGS

In order that the invention may be more clearly understood, embodiments thereof will now be described, by way of example, with reference to the accompanying drawings in which.

DETAILED DESCRIPTION

Figure 1:
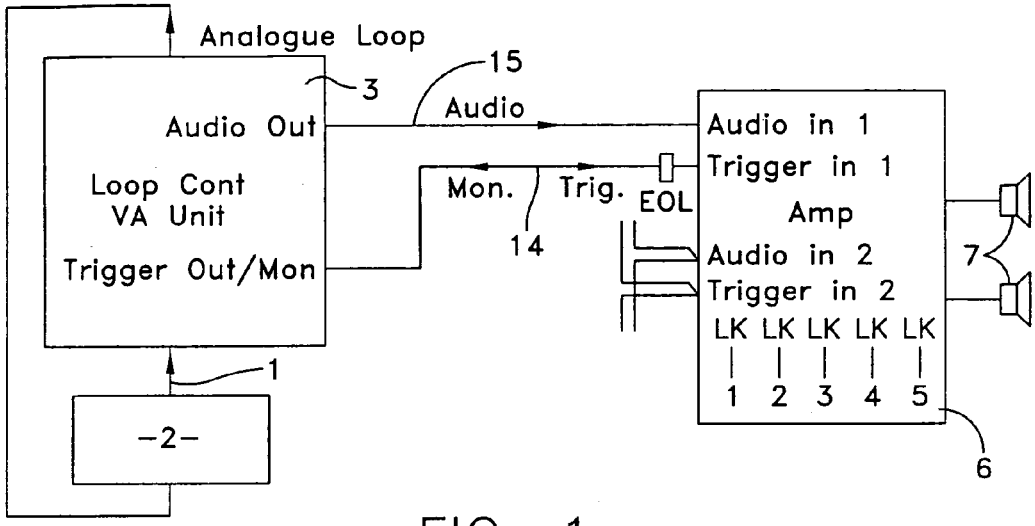
FIG. 1 shows a block circuit diagram for a single zone fire alarm incorporating a fire alarm addressable module according to the invention.

Referring to FIG. 1, the fire alarm system comprises the normal conventional analogue addressable fire alarm (FA) loop 1, beginning and ending with control equipment 2 adapted to control power and data sent over the loop. A fire alarm addressable module 3 is connected into the loop.

Figure 4:
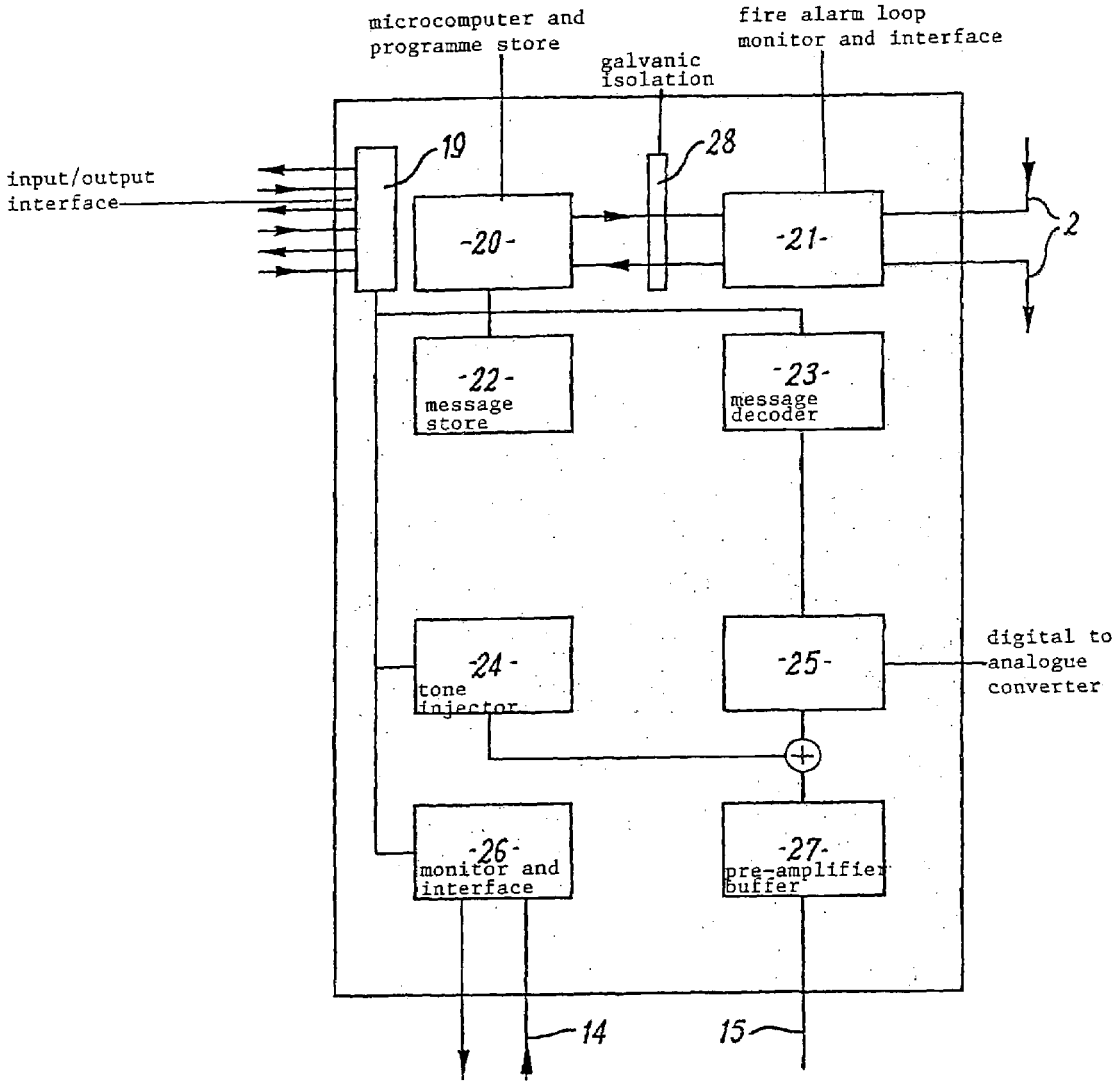
FIG. 4 shows a block circuit diagram for a module of the system of FIG. 1, 2 or 3.

This module 3 is shown in more detail in FIG. 4 It comprises an input/output interface 19, a microcomputer and programme store 20, a fire alarm loop monitor and interface 21, a message store 22, a message decoder 23, a tone injector 24, a digital to analogue converter 25, a monitor and interface 26 and a pre-amplifier buffer 27. The fire alarm loop monitor and interface 21 comprises means such as a DIP switch to identify itself on the loop 1 and to send information such as fault information generated from within the module or received externally from the monitor interface 26 and receive appropriate instructions from control and indicating equipment comprising the message store 22, i/o interface 19 and digital to analogue converter 25. The fire alarm loop monitor and interface module 21, which may be galvanically isolated at 28 from the rest of the module, communicates with the microcomputer and programme store 20 which forms the main information processing and control section for the module.

The i/o interface 19 contains the necessary controls to instruct the microcomputer and programme store 21 to operate in a specific mode to suit the application, for example, links to select specific messages, operational modes dependant on the state of the i/o interface 19 to the monitor and interface section 26. Interface may also provide discrete inputs to trigger different messages without the need for the analogue loop. These messages may be Evacuate, Alert, and Test. Many more messages may be selectable but this will depend on further enhancements o the FA protocol. There is not generally speaking a 'test' function within a FA control panel but there is a requirement to test the system. A voice alarm system needs a specific and unambiguous 'test' message. For those third party control equipment manufacturers who do not provide this programmability it will be necessary to 'hard wire' this discrete 'test' input to for example a 'test voice alarm' keyswitch'. 'Links' to programme other functions pertinent to the FA protocol so that the module will work in a specific manner when specific commands are received from the FA panel may also be provided.

'Links' to select for example inclusive or omission of monitoring tone so as to aid compatibility with third party amplifier manufacturers who have a different form of monitoring may be included.

The microcomputer and programme store 21 with regard to its programming and specific instruction from the i/o interface 19 will select a specific message from the message store 22 and route it through message decoder 23. This message decoder is required if the message store 22 is in the form of compressed data for example MP3. Although information is shown routed directly from the message store 22 to message decoder 23, this may not always be the case and it may be that the information is routed through the microcomputer and programme store 21.

The message decoder 23 then reconstitutes the message in a format suitable for conversion back to analogue audio and passes to the digital to analogue converter 25 buffered and outputted by the preamplifier buffer 27. A tone signal used for monitoring the audio path through the amplifier may be added to the signal prior to its pre-amplification by the tone injector 24. The tone injector 24 may be switched on/off as required by the microcomputer and programme store 21 and the interface conditions at 19. The monitor and interface 26 operates to send and receive monitored data from an amplifier 6 in a safe manner.

The module 3 is adapted to perform all the functions of a single zone voice alarm (VA) system and contains all the necessary electronics to interface to the FA loop 1, interpret its instructions and generate messages from the internal digital store 22. The messages are amplified by the amplifier 6 and played through speakers 7 connected to the amplifier 6.

A trigger line 14 and audio line 15 connect the module 3 to the amplifier 6. Trigger line 14 contains facilities to monitor and trigger the amplifier to increase its versatility.

- The module responds to a fault condition imposed on the trigger line 14 by the amplifier and transmits it back to the fire panel via the analogue addressable loop 1.
- The module will transmit a page function down the trigger line 14 to the amplifier to indicate that a message is coming and allowing the amplifier to perform any switching/muting that it requires.
- The amplifier will transmit down the trigger line a signal indicating a higher priority signal is coming and causing the muting of audible messages coming down the audio line from the module.
- The audio line 15
- Transmits the audio from the module 3 at a suitable level for the amplifier 6 to process.
- This audio may be of the 'balanced' type.
- This audio may have a tone e.g. 20 KHz embedded on it for monitoring purposes.

The reason for all these facilities is that in order for the amplifier 6 to have a diversity of uses it will need to switch/mix between inputs in a variety of manners under different priorities of trigger input. These priorities will be set within the amplifier 6 itself.

Figure 2:
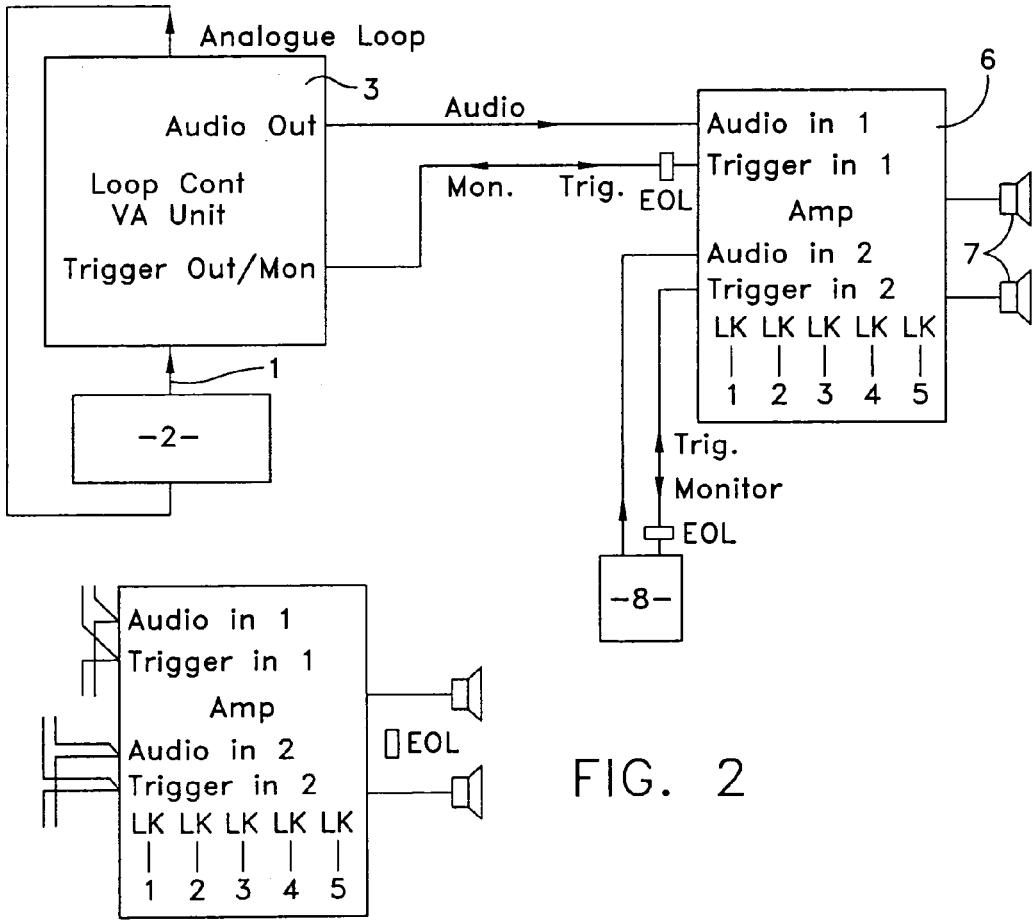
FIG. 2 shows a block circuit diagram for a modification of the system of FIG. 1.

Referring to FIG. 2, a block circuit diagram of a modified system is shown. The system is the same as that shown in FIG. 1, equivalent parts bearing the same reference numerals, but in addition a fireman's microphone 8 is connected directly to the amplifier to provide a facility for firemen to issue voice messages directly through the system when required.

Figure 3:
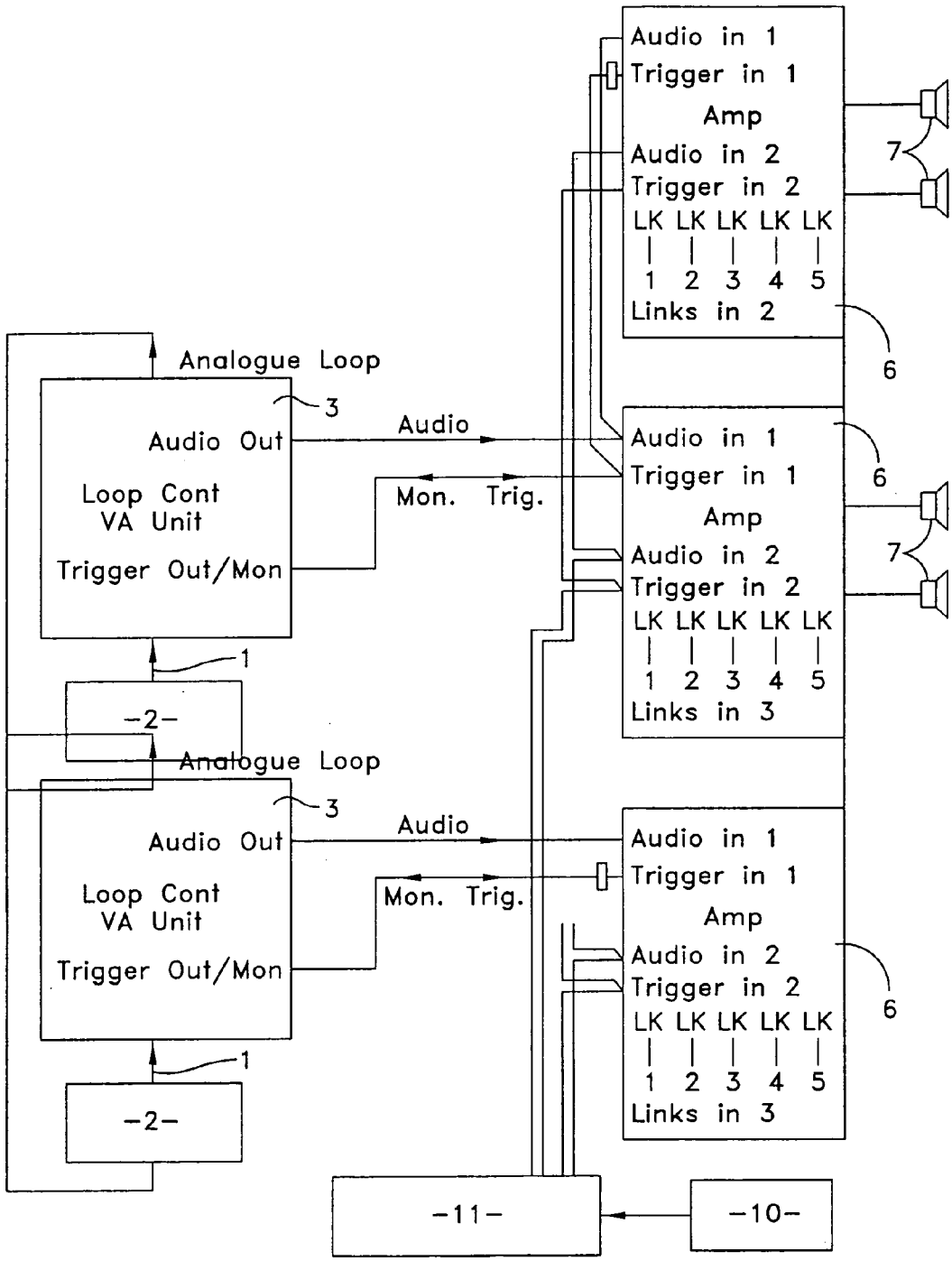
FIG. 3 shows a block circuit diagram for a multiple zone fire alarm system incorporating fire alarm addressable modules according to the invention.

Referring to FIG. 3, a block circuit diagram of a multiple zone system is shown. Parts equivalent to parts of the embodiments of FIGS. 1 and 2 bear the same reference numerals. Any number of fire alarm addressable modules 3 may be included in the FA loop 1. In this particular example two are shown. Also included in the loop is the control equipment 2. Each module is constructed and operates as the module 3 already described. In this way much larger systems to any desired size comprising essentially separate VA systems having individual modules could then be built up, the entire programming of these modules being part of the normal set up of the fire panel programming (providing the modules were chosen to emulate a class of analogue addressable output devices known as sounder controller modules). Fireman's evaluation control is carried out through a fireman's control panel 10 connected to an amplifier 6 via a PA/VA switching/monitoring/routing matrix unit 11. This unit 11 is connected to all the amplifiers thereby interconnecting them in a manner required for a public address (PA) system. Provision may also be made for the connection of a fireman's microphone in a manner similar to that shown in the embodiment of FIG. 2.

Systems constructed in the above described manner are much cheaper than existing systems. They are easier to programme at the fire panel as standard module type programming may be used. Such programming would have been necessary in any event for sounders if conventional fire alarm sounders had been used. The need for a traditional interface between the voice alarm and fire alarm systems is removed as is the need to programme the voice alarm (VA) system itself. Complex systems may be built up in a modular fashion and a public address (PA) system may be added without having to change the existing switching matrix.

The module 3 may be programmable to react as a sounder control module. This automatically maps sounder ringing patterns from a fire alarm control panel to fire alarm sounders. Several significant advantages can be obtained as follows:

The VA programming can simply be done at the FA panel by programming in the correct ringing patterns' a job easily done and known by the average FA engineer, without the need for any special programming tools and making the programming not dependant on any particular panel or function.

The system(s) monitoring can be relayed back to the FA panel as a matter of course.

Any triggers required to improve the sophistication/interfacing with e.g. a PA system can be embedded and transmitted out to the amplifier.

In addition the module 3 may include triggers and be able to monitor its trigger line to improve and obtain increased functionality and versatility and enable the expansion into much larger systems without the need for anything other than increased hardware to accommodate the number of speakers required. It should be noted that the module may be partially loop powered i.e. the bit that interfaces with the loop will be powered so as to report back fault signals. The audio output part will consume too much power and will therefore be powered through one of the connections to the amplifier.

It is intended that the 'module' 3 will interface with many different manufacturers amplifiers. The amplifier may be specifically designed to include functionality and features specifically designed to exploit the novelty of the unit.

It will be appreciated that the above embodiment has been described by way of example only and that many variations are possible without departing from the scope of the invention.

The invention claimed is:

1. A fire alarm addressable module, comprising:

means for interfacing with an amplifier forming part of a voice alarm system;

means for serially connecting the fire alarm addressable module in a fire alarm loop along which data and power may be transmitted;

a message store for storing one or more alarm messages; and means for interpreting signals received from the fire alarm loop and for selecting an appropriate message for transmission from the message store to the amplifier.

2. The fire alarm addressable module of claim 1, wherein the loop comprises control equipment for controlling the transmission of power and data over the loop.

3. The fire alarm addressable module of claim 1, wherein means are provided for the connection of amplifiers.

4. The fire alarm addressable module of claim 1, wherein a fireman's control panel is provided through which instructions can be fed to the system.

5. The fire alarm addressable module of claim 1, wherein an input/output interface is provided.

6. The fire alarm addressable module of claim 1, wherein a microcomputer and program store are provided.

7. The fire alarm addressable module of claim 1, wherein a fire alarm loop monitor and interface module are provided.

8. The fire alarm addressable module of claim 7, wherein the loop monitor and interface module are galvanically isolated from the remainder of the fire alarm module.

9. The fire alarm addressable module of claim 1, wherein a decoder is provided for decoding messages from the message store.

10. The fire alarm addressable module of claim 7, wherein the loop monitor and interface module comprise means enabling the monitor and module to be identified on the fire alarm loop.

11. The fire alarm addressable module of claim 1, wherein a tone injector is provided.

12. The fire alarm addressable module of claim 1, in which a digital to analog converter is provided.

13. The fire alarm addressable module of claim 1, wherein a monitor and interface are provided operative to receive instructions from control and indicating equipment comprising the message store.

14. A fire alarm system comprising a fire alarm loop along which data and power may be transmitted, a voice alarm system comprising one or more amplifiers, each amplifier being connected to one or more speakers for transmitting voice alarm messages, and one or more fire alarm addressable modules, the one or more fire alarm addressable modules including means for interfacing with the amplifier that forms part of the voice alarm system; means for serially connecting the fire alarm addressable module in the fire alarm loop a message store for storing one or more alarm messages; and means for interpreting signals received from the fire alarm loop and for selecting an appropriate message for transmission from the message store to the amplifier.

15. A fire alarm system comprising a fire alarm loop along which data and power may be transmitted, a voice alarm system comprising one or more amplifiers, each amplifier being connected to one or more speakers for transmitting voice alarm messages, and one or more fire alarm addressable modules, the one or more fire alarm addressable modules including means for interfacing with the amplifier forms part of the voice alarm system; means for interfacing with the fire alarm loop along which data and power may be transmitted; a message store for storing one or more alarm messages; and means for interpreting signals received from the loop and for selecting an appropriate message for transmission from the message store including a plurality of fire alarm addressable modules, each including a message store for storing a plurality of alarm messages and each disposed serially in said fire alarm loop.

16. A fire alarm system as claim in claim 15 wherein said plurality of alarm messages include different alarm messages that can be selectively played.

17. A fire alarm system as claimed in claim 16 wherein alarm messages from more than one module may be played simultaneously.

18. A fire alarm system as claimed in claim 17 wherein the message for selection from the message store is only transmitted to the voice alarm system and not the fire alarm system.

19. In an alarm system that has a fire alarm loop along which data and power signals may be transmitted and one or more amplifiers being respectively coupled to one or more speakers for transmitting voice alarm messages, at least one fire alarm addressable module that comprises, means for coupling said at least one fire alarm addressable module in series in said fire alarm loop, an audio terminal for connecting said fire alarm addressable module, via an audio line, to said one or more amplifiers, a massage store for holding one or more alarm messages, means for monitoring and interpreting signals transmitted on said fire alarm loop, and means responsive to said means for monitoring for selecting one of said alarm messages stored in said message store for transmission to said audio line.

20. A system of claim 19 wherein the message store holds a plurality of messages, any one of which can be selected.

21. A system of claim 19 wherein said means for monitoring comprises a fire alarm loop monitor and interface and said means for selecting comprises a microcomputer and program store.

22. A system of claim 21 wherein said fire alarm addressable module further includes an input/output interface coupled to said microcomputer and program store for controlling the selection from said message store.

23. A system of claim 19 wherein said alarm messages are coupled only from said message store.

* * * * *